US011889886B2

(12) United States Patent
Fox

(10) Patent No.: US 11,889,886 B2
(45) Date of Patent: Feb. 6, 2024

(54) TUNED SOLE SHANK COMPONENT FOR DANCE FOOTWEAR

(71) Applicant: FOX INVESTMENTS LIMITED, St Peter Port (GG)

(72) Inventor: David Fox, St Helier (JE)

(73) Assignee: Fox Investments Limited, St. Peter Port (GG)

( * ) Notice: Subject to any disclaimer, the term of this patent is extended or adjusted under 35 U.S.C. 154(b) by 0 days.

(21) Appl. No.: 16/616,319

(22) PCT Filed: Oct. 8, 2018

(86) PCT No.: PCT/IB2018/057787
§ 371 (c)(1),
(2) Date: Nov. 22, 2019

(87) PCT Pub. No.: WO2019/030743
PCT Pub. Date: Feb. 14, 2019

(65) Prior Publication Data

US 2021/0345728 A1 Nov. 11, 2021

Related U.S. Application Data

(60) Provisional application No. 62/542,519, filed on Aug. 8, 2017.

(51) Int. Cl.
*A43B 13/14* (2006.01)
*A43B 5/12* (2006.01)
(Continued)

(52) U.S. Cl.
CPC ..... *A43B 13/141* (2013.01); *A43B 5/12* (2013.01); *A43B 13/026* (2013.01); *A43B 13/12* (2013.01)

(58) Field of Classification Search
CPC ..... A43B 13/141; A43B 3/248
(Continued)

(56) References Cited

U.S. PATENT DOCUMENTS 6,079,126 A 6/2000 Olszewski
7,036,244 B1 5/2006 Finch
(Continued)

FOREIGN PATENT DOCUMENTS

EP 997081 A1 * 5/2000 ..... A43B 17/00
GB 2156652 A * 10/1985 ..... A43B 5/12
(Continued)

OTHER PUBLICATIONS

International Search Report and Written Opinion for PCT Application No. PCT/IB2018/057787, dated Jan. 21, 2019, 9 pages.

*Primary Examiner* — Sharon M Prange
*Assistant Examiner* — Grady Alexander Nunnery
(74) *Attorney, Agent, or Firm* — Ganz Law, PC

(57) ABSTRACT

A dance shoe having an upper and an underfoot portion, the underfoot portion includes a sole shank, consisting of a relatively rigid structure, extending longitudinally in the shoe over at least a forefoot portion of the shoe and at least partially over a midfoot portion. The sole shank has at least one hinge with a unidirectional stop disposed widthwise in the sole shank. The sole shank covers at least the forefoot portion of the underfoot area and it locks to support plantar flexion and hinges to facilitate dorsiflexion of the foot. To facilitate en pointe movements, the sole shank may be coupled to a rigid distal part of the shoe, such as a toe box. The inventive subject matter is also directed to dance shoes, as well as the sole shanks themselves, and to methods of making the sole shanks and using the sole shanks in assemblies.

12 Claims, 9 Drawing Sheets

(51) Int. Cl.
*A43B 13/02* (2022.01)
*A43B 13/12* (2006.01)

(58) Field of Classification Search
USPC ..... 36/8.3
See application file for complete search history.

(56) References Cited

U.S. PATENT DOCUMENTS

| | | | | |
|---|---|---|---|---|
| 7,900,375 | B2 | 3/2011 | Thoraval | |
| 8,082,682 | B2 | 12/2011 | Karl et al. | |
| 9,009,988 | B2 | 4/2015 | Jacobs et al. | |
| 2005/0022421 | A1* | 2/2005 | Bruckner | A43B 5/12 36/11 |
| 2006/0143945 | A1* | 7/2006 | Walker | A43B 13/141 36/8.3 |
| 2007/0266598 | A1 | 11/2007 | Pawlus et al. | |
| 2009/0151200 | A1 | 6/2009 | Niedermeyer et al. | |
| 2010/0018080 | A1* | 1/2010 | Smith | A43B 3/24 36/102 |
| 2010/0126042 | A1 | 5/2010 | Wyon | |
| 2010/0186257 | A1 | 7/2010 | Karl et al. | |
| 2010/0281715 | A1 | 11/2010 | Cayol et al. | |
| 2013/0174444 | A1 | 7/2013 | Jacobs et al. | |
| 2015/0089841 | A1* | 4/2015 | Smaldone | A43B 23/0235 36/103 |

FOREIGN PATENT DOCUMENTS

| | | |
|---|---|---|
| WO | 02087374 | 11/2002 |
| WO | 2019229043 | 12/2019 |
| WO | 2020087034 | 4/2020 |

* cited by examiner

TUNED SOLE SHANK COMPONENT FOR DANCE FOOTWEAR

BACKGROUND

The inventive subject matter is generally directed to a dance shoe. It is particularly directed to a pointe shoe that includes a rigid toe box and a sole shank extending longitudinally from a distal portion to a proximal portion of the shoe.

Ballet dancers use specifically designed pointe shoes to assist the dancer to stand on the tips of their toes, referred to as dancing "en pointe." The pointe shoe typically provides support to the dancer's foot through a toe box, which is a rigid structure encasing the front of toes and some or all of the rest of the forefoot, and a shank, which extends longitudinally therefrom. The toe box generally hugs the foot across the metatarsal so that the sides of the dancer's foot are held in place. The shank is an elongate, rigid element that is structurally coupled (e.g., as a separately attached or as an integrated piece) to the toe box and extends rearwardly from the toe box, typically at least across the midfoot region to the rearfoot region of the shoe, in the bottom, foot-supporting portion of the shoe. When dancing en pointe, the shank and toe box help support the foot and help distribute the dancer's weight across a broader area foot instead of the weight being concentrated in the toes. To effectively spread the weight, the shoe should fit tightly to the dancer's foot.

Extensive training and practice are required to develop the strength and technique needed for pointe work. Proper pointe technique requires not only proper foot placement such that the toes are perpendicular to the floor to maximize the contact surface area of the platform (i.e., the flattened tip of the toe box) with the floor, but also proper body alignment to form a straight "line" extending from the center of the hip through the toes. If proper pointe technique is not used, serious injuries may occur. In addition, pointe shoes are generally not used until the shoes have been broken-in. The process of breaking-in a new shoe, often effort intensive, includes a variety of actions such as bending and twisting the shoe until it has a desired flexibility. Because of such manipulations, the toe box and/or shank of a pointe shoe may become weakened and vulnerable to degradation, making the shoe less supportive with use.

One of the problems with traditional pointe shoes is the difficulty to balance between the stiffness and flexibility of the shoe. While the rigid toe box and shank of a pointe shoe provide structural support for the foot in plantar flexion (e.g., en pointe or tendu positions), the lack of flexibility of the pointe shoe may limit the range of other foot flexions (e.g., neutral or dorsiflexion), in particular when frequent transitions between foot flexions occur, e.g., when the dancer is walking, running, or jumping.

Another common problem with traditional pointe shoes is the lack of a mechanism to assist the dancer to perform pointe work with proper foot placement and body alignment. When transitioning to en pointe, a dancer receives no feedback whether the foot reaches a fully extended, vertical orientation. Both under- and over-plantar flexion of the foot are undesirable for en pointe since they not only undermine the aesthetic aspect of the dance, but also can create significant possibilities of strains and injury to the dancer's foot.

The following is a list of related prior art, although none of them successfully resolved the aforementioned problems:

U.S. Patent Pub. No. 20090151200 A1, Niedermeyer et al.

U.S. Pat. No. 7,036,244 B1, Finch

U.S. Pat. No. 9,009,988 B2, Jacobs et al.

U.S. Patent Pub. No. 20050022421 A1, Bruckner.

Accordingly, there is a need for a pointe shoe and other dance shoes that support the foot, while conforming to the foot through a range of foot flexions, including those that correspond to the en pointe position. There is also a need for a pointe shoe and similar dance shoes that assist dancer to perform pointe work while inhibiting the dancer's foot from over-plantar flexion.

SUMMARY

The inventive subject matter provides an advance over the prior art. In certain embodiments it is directed to a dance shoe having an upper and an underfoot portion, the underfoot portion includes a "sole shank," explained in more detail below, consisting of a relatively rigid structure extending longitudinally in the shoe over at least a forefoot portion of the shoe and at least partially over a midfoot portion. The sole shank has at least one hinge with a unidirectional stop disposed widthwise in the sole shank. The sole shank covers at least the forefoot portion of the underfoot area and it locks to support plantar flexion and hinges to facilitate dorsiflexion of the foot. To facilitate en pointe movements, the sole shank may be coupled to a rigid distal part of the shoe, such as a toe box.

In certain embodiments, the inventive subject matter is directed to: a sole shank including a relatively rigid material configured to extend longitudinally in a shoe over at least a forefoot portion of the shoe and at least partially over a midfoot portion, at least one hinge with a unidirectional stop being disposed widthwise in the sole shank in at least the forefoot portion so that the sole shank locks to support plantar flexion and hinges to facilitate dorsiflexion of the foot, the sole shank being coupled to a rigid distal part of the shoe.

In certain embodiments, the inventive subject matter is directed to: a dance shoe, including: a distal part having a rigid toe box for encasing at least a portion of a forefoot of an intended wearer and supporting the wearer's foot; an intermediate part coupled to the distal part and configured for receiving at least a portion of a midfoot of the intended wearer; a proximal part coupled to the intermediate part and configured for receiving at least a rearfoot portion of the intended wearer; and a sole unit comprising a sole shank extending longitudinally from the distal part to the proximal part, wherein the sole shank has at least one hinge with a unidirectional stop disposed widthwise in the sole shank in at least a forefoot portion that locks to support plantar flexion and hinges to facilitate dorsiflexion of the foot.

In certain embodiments, the inventive subject matter is directed to: methods of marking the dance shoes and sole shanks claimed herein comprising forming a sole shank with one or more hinges with unidirectional stops. The method may further include the step of assembling the sole shank to another part, such as an upper or sole unit, or component thereof.

In any embodiment, the rigid distal part may be a rigid toe box. In any embodiments, the unidirectional stop may be a living hinge. In any embodiment, a plurality of living hinges with unidirectional stops, the hinges being disposed widthwise and generally parallel to one another. In any embodiment, one or more hinges may be non-linear. In any embodiment, in any embodiment, one or more of the hinges may have an undulating form. In any embodiment, three or more living hinges may have an undulating form. In any embodiment, the living hinges may be formed in a board such as a fiber board (e.g., Redboard). In any embodiment, the sole shank may be a laminate of multiple layers, at least two being boards. In any embodiment, the length of the sole shank may be about equal to the full length of the sole unit. In any embodiment, the length of the sole shank may be longer than half but shorter than full length of the sole unit. In any embodiment, the width of the sole shank may be about equal to the width of a sole unit in the dance shoe. In any embodiment, the width of the sole shank may be substantially narrower than the width of the sole unit, and the sole shank substantially on a central axis of the shoe. In any embodiment, sole shank may be a fiber-reinforced plastic plate. In any embodiment, the fiber-reinforced plastic plate may be a carbon fiber plate In any embodiment, the sole shank may be affixed to one or more layers of support board included in a sole unit in the shoe. In any embodiment, the sole shank may be pre-shaped in a three-dimensional form to facilitate plantar flexion of the intended wearer's foot. In any embodiment, the three-dimensional form may represent an intended wearer's foot in a plantar-flexed position, in particular a curved shape near an arch portion of the intended wearer's foot. In any embodiment, the sole shank may have at least three zones of flexibility comprising a stiff zone located near a toe portion of the intended wear's foot, a flexible zone located near a ball portion of the intended wear's foot, and a stiff zone located near an arch portion of the intended wear's foot. In any embodiment, the sole shank may have four zones of flexibility comprising a stiff zone located near a toe portion of the intended wear's foot, a flexible zone located near a ball portion of the intended wear's foot, a stiff zone located near an arch portion of the intended wear's foot, and a flexible zone located near a heel portion of the intended wear's foot. In any embodiment, the multiple zones of flexibility may be created by at least varying thickness of the sole shank in different zones. In any embodiment, the multiple zones of varying flexibility may be created by at least varying material and/or structural attribute of the sole shank in different zones. In any embodiment, multiple zones of varying flexibility may be created by at least varying a weave pattern of the sole shank in different zones. The inventive subject matter is also directed to the sole shanks themselves and to methods of making the sole shanks and using the sole shanks in assemblies.

Other embodiments are contemplated in the Detailed Description below, the appended Figures, and in the claims, as originally written or amended, the claims as such being incorporated by reference into this Summary. The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art. The figures presented are for illustrative and explanatory purposes and are not necessary in scale.

DETAILED DESCRIPTION

Figure 1A:
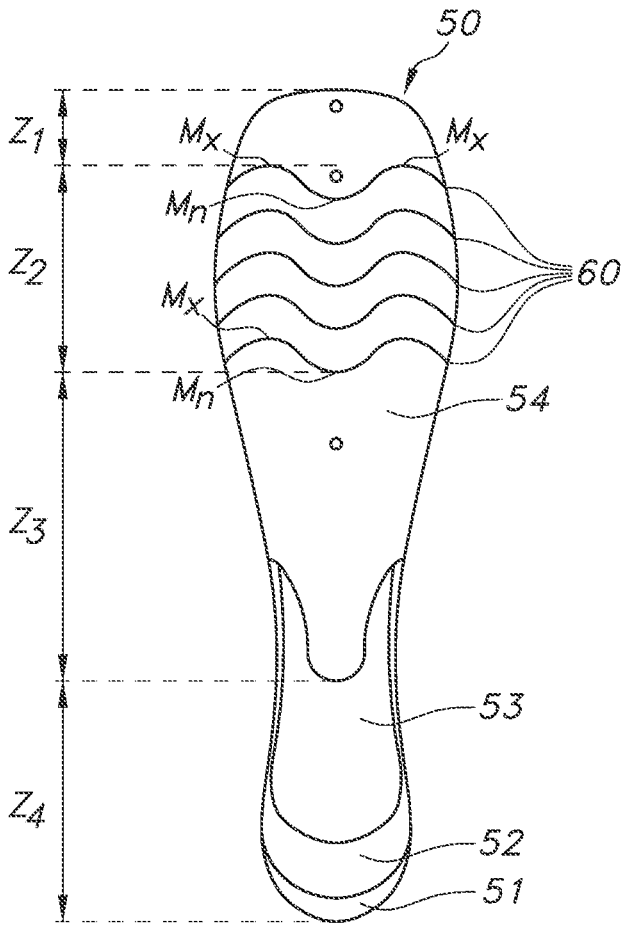
FIGS. 1A-1B show respectively bottom and top views of a sole shank with unidirectional flex capability.
Figure 1B:
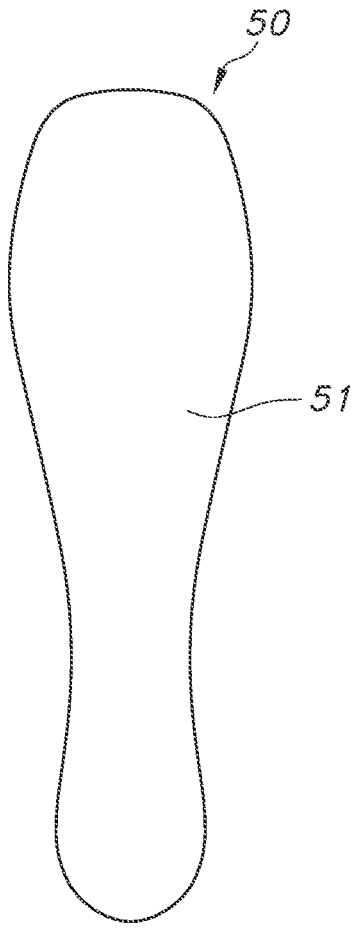

Representative embodiments according to the inventive subject matter are shown in FIGS. 1-10, wherein the same or generally similar features sharing common reference numerals.

The inventive subject matter is generally directed to shoes that provide a foot conforming fit and support through a range of foot flexions, including those that correspond to the demi pointe, en pointe, and tendu positions, and provide a system to support the foot and inhibit over plantar flexion, while not inhibiting dorsiflexion of the intended wearer's foot.

Dance shoes, particularly those intended for ballet, jazz dancing, character dancing, and ballroom dancing may embody the inventive subject matter. Often, such shoes include a distal part that has rigid section for supporting and protecting an intended user's forefoot during plantar flexion. Pointe shoes, for example, have a distal part in the form of a rigid toe box that encases at least the toes of a dancer. The toe box provides support and helps protection a dancer's foot en pointe. The distal part is coupled to a proximal part that is configured for receiving midfoot to rearfoot portions of the foot. In conventional pointe shoes, the proximal part includes a rigid shank that structurally couples with the toe box. However, while the shank/toe box support the foot en pointe, they do not adequately flex with and conform to the foot as it leaves plantar flexion and goes into dorsiflexion.

To overcome such disadvantages, the proximal part includes a structure with selected and directionally controllable rigidity. The structure may be in the form of a board or a resilient plate structure. The board or plate may be structurally coupled to the distal part. For example, it can be a separate element affixed to the distal part or it may be a portion of a unitary structure with the distal part. In any case, the structure is designed to flex with the foot as it goes into dorsiflexion. But it can also flex with the foot as it goes into plantar flexion. To inhibit the foot from over plantar flexion, the structure includes at least one unidirectional stop that inhibits the structure from bending beyond a desired degree of plantar flexion. Thereby, the structure helps support the foot through that degree of plantar flexion and inhibits the foot from going beyond it. The structure therefore provides the functionality of both a rigid shank and a flexible sole in a single unit. A structure that serves such functions may be referred to herein as a "sole shank".

Figure 2:
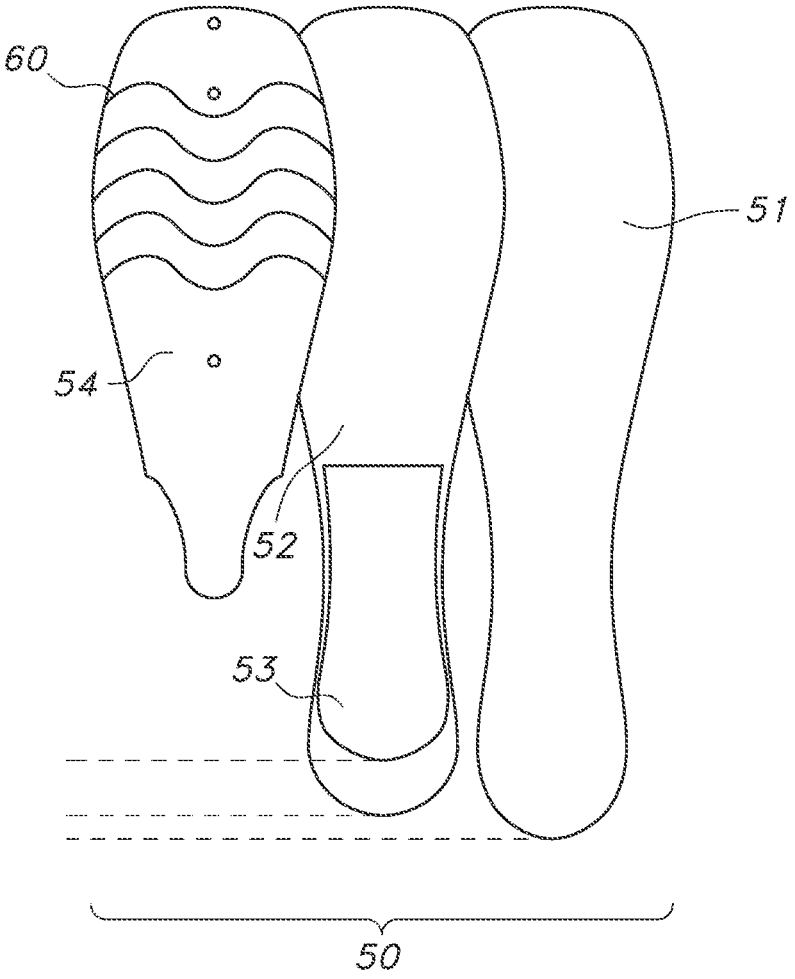
FIG. 2 shows an exploded view of the sole shank of FIG. 1A.
Figure 3A:
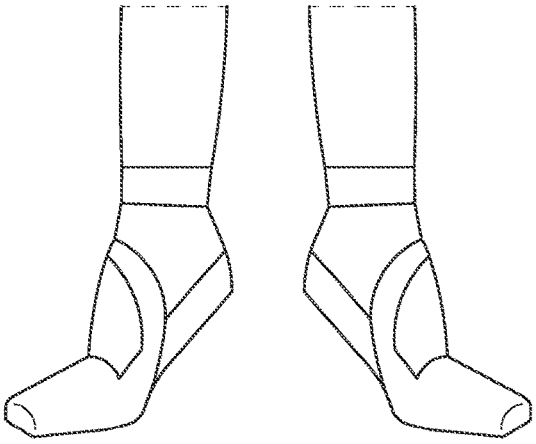
FIG. 3A shows human feet in footwear in the dorsiflexion position.
Figure 3B:
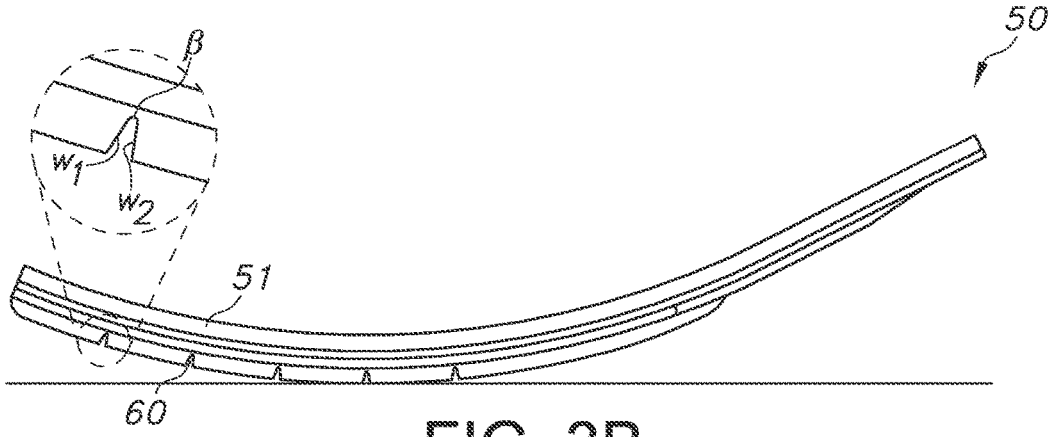
FIGS. 3B-3D show side elevations of the sole shank of FIG. 1 in, respectively, dorsiflexion, neutral and plantar flexion configurations.
Figure 3C:
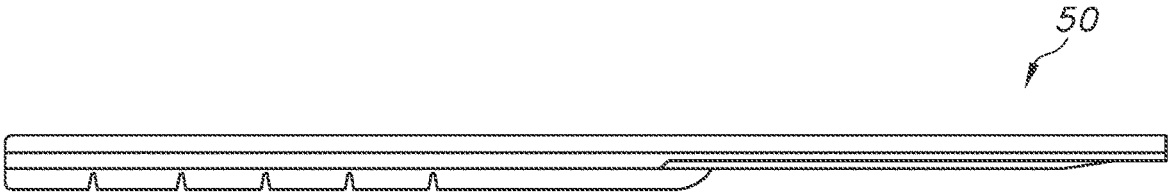
Figure 3D:
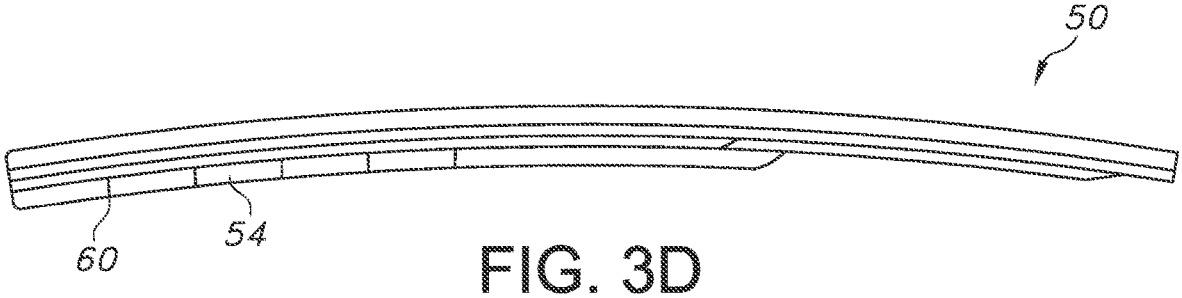
Figure 4A:
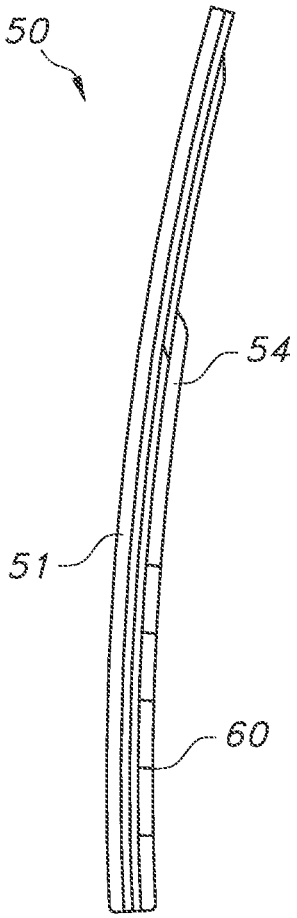
FIG. 4A shows a side elevations of the sole shank of FIG. 1 in a plantar flexion configuration.
Figure 4B:
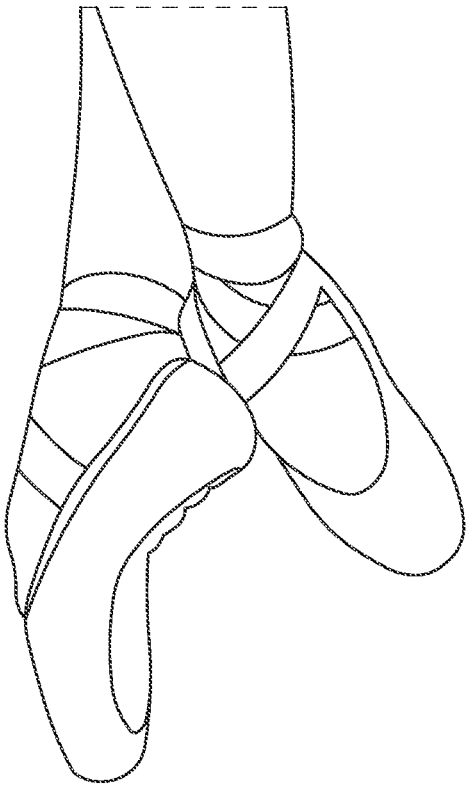
FIG. 4B shows a human foot in footwear in the plantar flexion (en pointe) position.
Figure 5:
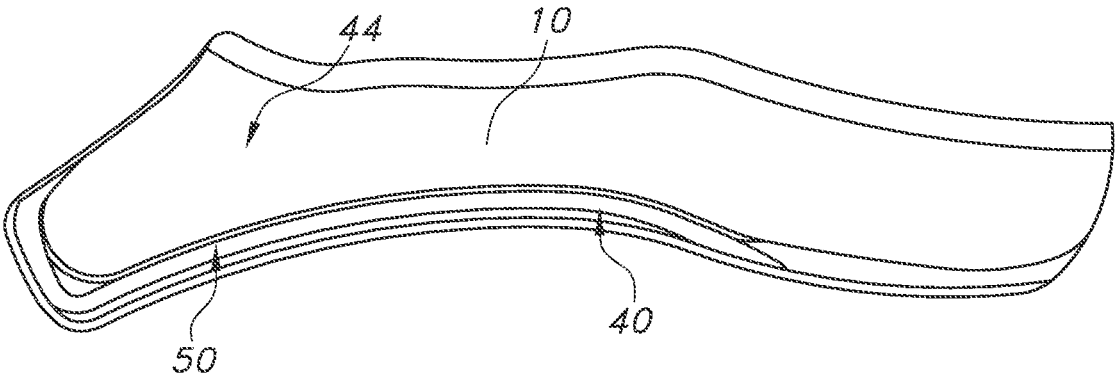
FIG. 5 shows a side, longitudinal cutaway of a dance shoe, such as a pointe shoe, incorporating a sole shank.

FIGS. 1-5 show one possible embodiment of a sole shank in accordance with the inventive subject matter. FIGS. 1A-1B show, respectively, bottom and top views of a sole shank 50 with unidirectional flex capability. In this example, the sole shank has a multilayer, laminate construction of varying materials. FIG. 2 shows an exploded view of the sole shank of FIG. 1A. FIGS. 3A-3B show side elevations of the sole shank in, respectively, dorsiflexion, neutral and plantar flexion configurations. FIG. 3.1 shows human feet in footwear in the dorsiflexion position, illustrating how the sole shank can flex with and conform to a foot in that position. Similarly, FIG. 4 shows sole shank 50 in a plantar flexion configuration. FIG. 4.1 shows a human foot in footwear in the plantar flexion (en pointe) position, illustrating how the sole shank can conform to and support a foot in the position. FIG. 5 shows a cutaway of a dance shoe, such as a pointe shoe, incorporating a sole shank in an underfoot portion.

Figure 6A:
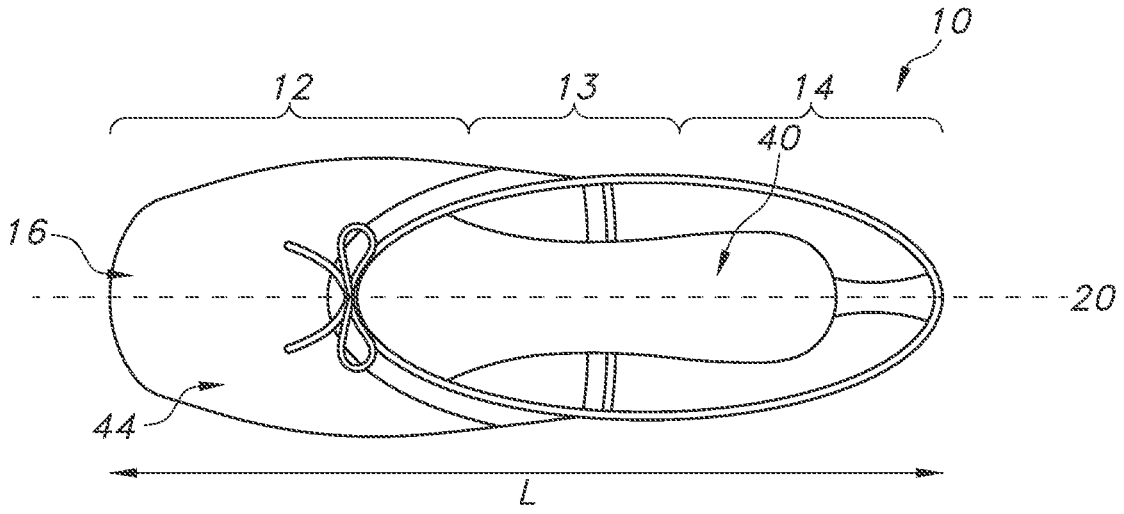
FIGS. 6A-6C show the top view of a dance shoe having a sole shank according to one possible embodiment of the inventive subject matter, and separate views of the sole shank and a support board.
Figure 6B:
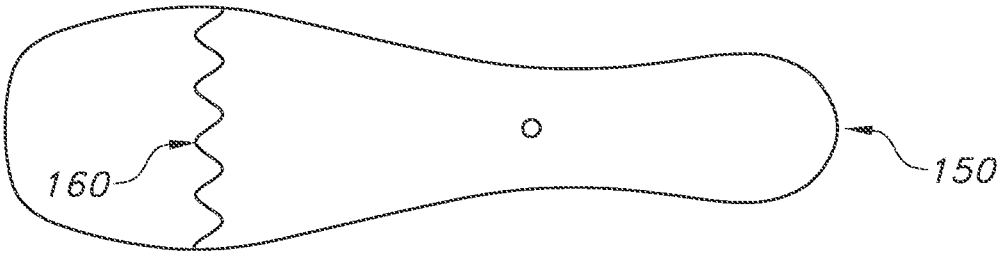
Figure 6C:
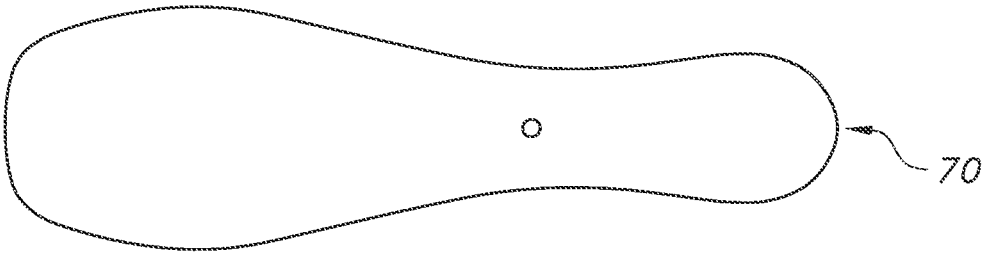
Figure 8:
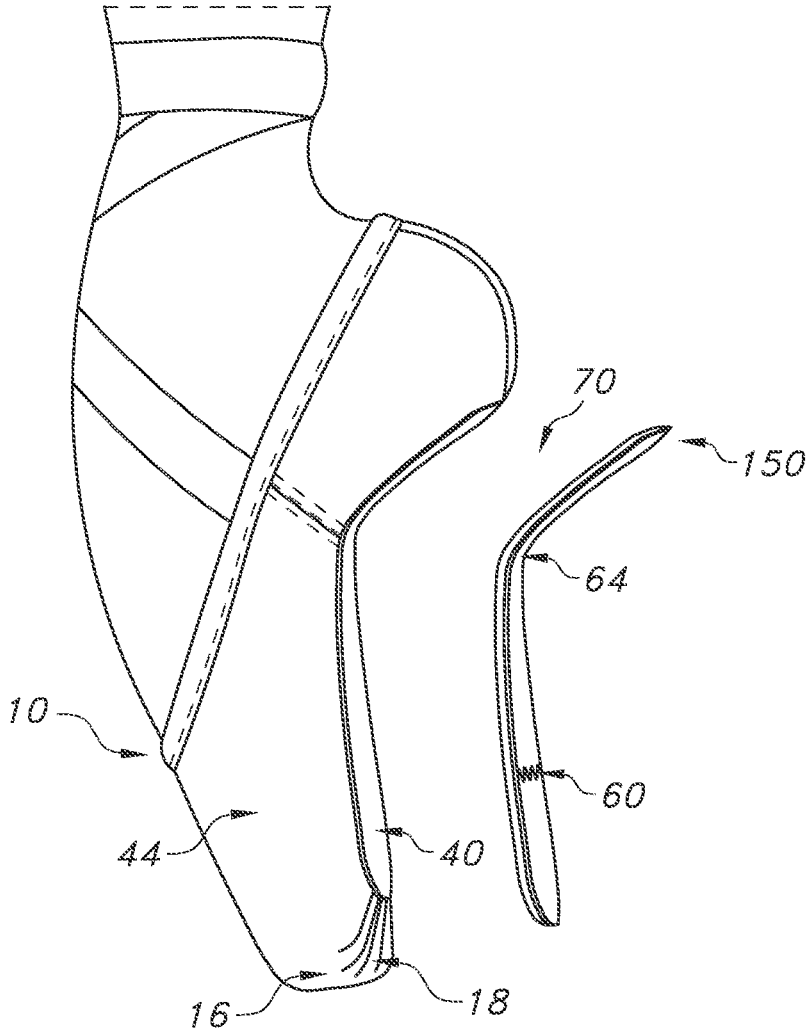
FIG. 8 shows a foot en pointe and wearing a pointe shoe which has a pre-shaped sole shank according to one possible embodiment of the inventive subject matter, with a separate view of the sole shank.

Per certain embodiment of the inventive subject matter, the sole shank has one or more unidirectional stops 60 in the distal part corresponding to the forefoot region, as shown in FIG. 6B and FIG. 8. The unidirectional stop may be configured into one or more living hinges. Generally, as used herein, a living hinge is a flexible bearing formed in the surface of a substrate structure and is generally made from the same material, or composite of material layers, as the two relatively rigid sections connected on either side of the hinge. The substrate material for the living hinge is typically thinned or or cut along a predetermined line (linear or nonlinear) to allow the interconnected sections to bend or rotate along the line.

In the inventive subject matter, a living hinge may be formed in one or more layers of material making up the sole shank structure. In general, a living hinge is a groove or channel with sidewalls that are separated by a small gap, or the walls may be in contact but separable. Those walls converge into a closed bottom. The closed bottom may be a floor (i.e., a generally horizontal surface) or an apex.

The opposing walls $W_1$, $W_2$ of a living hinge may converge to a bottom B in the form of a floor or an apex in any of various ways. The walls and floor may have, for instance, a u-shape, a v-shape, or various other shapes representing a recessed area. As another example, a groove or channel of a living hinge may have more than two walls/floor, as in an accordion shape, with more than three or more walls in alternating angles. The walls in any living hinge may therefore be parallel or angled as they converge to a flat or radiused floor or to an apex. They may also be linear or nonlinear. For example, they could straight or have a convex or concave form.

When the sole shank is in a neutral position (its default, unweighted form), the walls $W_1$, $W_2$ may be closely adjacent and even in close contact but separable. Or they be separated by a predetermined amount. In some embodiments, suitable gaps at the top of the walls may be from 0.7 mm to 1 mm, or thereabout. The groove or channel defining a line of flex may be a continuous structure that runs a predetermined length in a structure to define the line of flex. Or the line of flex may have a discontinuous groove or channel where the line of flex is defined by depressions in the surface material separated by apertures (i.e., through holes) in the substrate material(s). Think of a row of alternating dashes and dots: the dashes represent depressions in a substrate material's surface; and the dots represent apertures that separate the dashes. The line of depressions and apertures therefore can act as a living hinge based on the overall weakening of the substrate along such line. Again, such line may be considered a discontinuous groove or channel. In such a structure, the attributes of the depressions and apertures may be varied in any number of ways to control flex, including by varying their shapes and dimensions.

To selectively control rigidity/flex in a sole shank, the depth of continuous or discontinuous grooves or channels in substrate material(s) may vary. For example, relatively deeper grooves or channels will be relatively more flexible than shallower grooves or channels in the same substrate. In suitable embodiments, the grooves or channels may be formed with a depth sufficient to create a flexural line. In typical applications, it is expected that a sufficient depth will be at least 0.5 mm into the depth of the substrate structure from its surface. The maximum depth can be 100%. In other words, a substrate material can be cut through and fastened to an adjacent plate or board that is continuous below the cut-through segments. The segments could be fastened in any way that materials can be fastened including chemical bonding based on adhesives or fusing of materials or by mechanical fasteners.

In any given groove or channel, the depth may be uniform or it may vary across its length. For example, varying the depth may provide more less flexing on one side of the sole shank versus the other. Such variations may also be made from row to row in set of living hinges.

The unidirectional stop in a living hinge may be based on the abutment of the opposing vertical walls. The opposing walls separate as the sole shank flexes from a neutral position into dorsiflexion (FIGS. 3A and 3.1), allowing the sole shank to dorsiflex with the foot. The opposing walls converge into abutment as the sole shank goes from a neutral position into plantar flexion, allowing the sole shank to lock and support the foot during plantar flexion, including en pointe and tendu positions. In the embodiment of FIGS. 1-5, a plurality of generally parallel rows of living hinges with unidirectional stops are formed in a forefoot portion of the sole shank. In this embodiment, the hinges are disposed primarily under the ball of the intended user's foot. By spacing the living hinges over the forefoot area shown, the hinges collectively allow the sole shank to follow the dorsiflexion of that part of the foot but lock as the foot goes through plantar flexion.

In the embodiment shown, the living hinges 60 have a non-linear form. Advantageously, a non-linear form increases the surface area of abutting walls in the living hinges for a stronger support system. More particularly, the living hinges in the embodiment shown have a wavy, undulating form. The curving, wavy lines maximize wall surface area across the width of the sole shank and allow for smoother mechanical engagement and disengagement. The curving form also helps reduce wear by avoiding sharp corners that would suffer higher engagement force on abutment.

The undulating form has a plurality of minima $M_n$ and maxima $M_x$ (collectively known as extrema) across the width. The extrema spaced generally across the width of the sole shank in each of a plurality of rows. For many applications, from 1-3 extrema per row will be suitable. The number of extrema may be the same or vary from one row to another. For example, a wider portion of the sole shank may have more extrema compared to a narrower area. In the embodiment shown in FIGS. 1-5, there are central minima disposed at the center of the sole shank or thereabouts. There are lateral maxima on either side of each central maxima for a total of three extrema in each row.

As used herein, an undulating form may be not only a curvaceous waveform but it also may be a zig zag or square wave form, or any of various other such forms of cycling. The extrema in an undulating form may have uniform wavelength and amplitude across a given row or from one row to another. For instance, in the embodiment shown, the central minima in each row have a longer wavelength than the adjacent maxima. However, in other embodiments, the extrema may have the same wavelengths to make a uniform distribution of extrema. Further, the waveform pattern in one row can differ from any other row. In the example of FIGS. 1-5, each row has substantially the same wave form pattern. Suitable wavelengths may range from 5 cm to 7 cm, or thereabout, and suitable amplitudes may range from 0.7 cm to 1 cm, or thereabout As indicated, the living hinge may be formed in a single layer of the same material or through multiple layers of the same or different material, which are laminated together into a unitary structure. Living hinges could be formed in a substrate by laser cutting, mechanical grooving, chemical ablation, and any other known techniques for forming recessed areas in a substrate's surface.

In addition to living hinges, the unidirectional stop used in a flex line may be included in other forms. For example, there are well-known pin-coupled hinge systems with unidirectional stops, like those used in doors and cabinetry. Such systems could be scaled down adapted for use in a sole shank. Further, a hinge with a unidirectional stop could be in a unitary piece of material(s) or it could interconnect discrete structures on one or both sides. It could be itself a discrete structure that interconnect discrete structures on either side. In other words, a hinge could be any bridging of other sections that provides a line for unidirectional bending or rotation of the interconnected sections.

Looking at the sole shank of FIGS. 1-5, the sole shank 50 is a unitary structure with multiple layers, 51-54 of the same or different materials. The layers may be affixed to each other through known means, such a mechanical or adhesive bonding. They may also be formed as different layers of molded polymer material. For example, such layering may be performed using known comolding or overmolding processes. Moving along the sole shank's longitudinal line, the number of layers and/or properties in a given layer in the laminated composite structure may be uniform. Alternatively, they may vary to provide varying support and flexibility in selectively tuned sections.

For example, in FIG. 1A, the sole shank is defined in terms of a plurality of zones $Z_1$-$Z_4$, which represent sections where the stiffness/flexibility vary from one section to another. Variations may be achieved by varying, for example, the durometer, thickness, or structural features of one zone relative to another. An example of structural variation would be the various possible continuous and discontinuous living hinges detailed earlier. In the sole shank shown, the top layer 51 comprises a relatively rigid, full-length fiber board, made of fibers and adhesives. The top layer serves as a foot supporting element and is tuned to provide a balance of rigidity and flexibility to achieve the objectives of the sole shank. One suitable fiber board in known in the art as "Redboard". Redboard is a man-made fiber board which is made of fiber and adhesive. It is relatively stiff when provided in thicknesses sufficient to support the foot en pointe. While it can support the user's foot in an appropriate thickness (i.e., an individual layer or laminated layers), the support is provided at the sacrifice of flexibility, with dorsiflexion being impeded. Accordingly, in the inventive subject matter, layer 51 is not provided in a thickness that is overly rigid, and hinges may be provided in other layers, as discussed below, to improve the flexibility of the overall sole shank while providing needed rigidity. Other relatively rigid boards functionally similar to Redboard may be used as top layer 51. For example, there are various known rigid boards made of fibers, leather, metal, polymers, or a combination of such materials. Although the top layer is shown as a full-length unit, it may have varying lengths. For example, it could be a ¾ or ½ length board extending partially towards the end of the rearfoot. Although not shown, the top layer may not be the top most layer in a shoe. For instance, a comfort liner, or cushiony insole may be disposed in a foot compartment above layer 51.

Below and adjacent top layer 51 is intermediate layer 52. This layer may be a leather board. It may be full length as shown or partial length like the top layer. This layer is relatively flexible and may serve to interconnect and stabilize stiffer layers above and below it. In addition to natural leather, layer 52 may be a synthetic leather or a durable textile material.

Below and adjacent the intermediate layer 52 is another intermediate layer 53. This layer may be made of Texon board, a cellulosic fiber board, disposed in a midfoot-rearfoot section of the sole shank. It helps provide functional cohesiveness to the over allows the other layers of the sole shank to bend without separating.

Finally, in this example, adjacent and below the intermediate layer is a bottom layer 54. The bottom layer may be full length or partial length. In this case, it is a partial length layer that extends from the distal end of the forefoot to about the distal-most side of the rearfoot or to about the proximal-most side of the midfoot. The bottom layer leaves the intermediate layers partially exposed on the bottom side in the proximal midfoot to rearfoot sections of the sole shank. The bottom layer is a relatively stiff layer that provides substantial support to the foot en pointe. The other layers may be relatively less rigid standing apart from the bottom layer. The addition of the bottom layer stiffens the overall structure of the sole shank so that it is suitable for supporting the foot en pointe and in other plantar flexions. However, to provide for needed dorsiflexion, living hinges 60 are disposed only in the forefoot section of bottom layer 54, section $Z_2$. Section $Z_2$ is disposed behind a relatively less flexible distal forefoot section $Z_1$. That section may be part of a rigid toe enclosure, such as a toe box. Because it has hinges, section $Z_2$ unidirectionally flexes with the intended user's foot during dorsiflexion but locks the sole shank as the user's foot moves into plantar flexion. In this embodiment layer 54 is the substrate material for the hinges. The hinges may be formed partially or fully through the surface layer 55. If formed fully through, the cut segments of layer 55 may be bonded to adjacent intermediate layer 52, with walls $W_1$ and $W_2$ being formed in bottom layer 54 and the surface of intermediate layer 52 serving as bottom B.

The bottom layer 54 has a generally tear-drop shape, tapering into a narrow shank as it extends towards the rearfoot. This shape supports the foot across midfoot $Z_3$, which is relatively stiff compared to rearfoot section $Z_3$, because section $Z_3$ consists for three layers and section $Z_4$ consists of two layers or three layers, with layer 53 being relatively flexible.

It should be appreciated that the foregoing embodiment is non-scope limiting example within the broader scope of the inventive subject matter. Many variations are possible. For example, multiple layers could be provided in the form of single layer that provides the same general functionality. Layers may be varied in lengths and positions in the overall sole shank and with respect to each other. Other variations are possible, as well, with any variation serving a common general object of providing a sole shank that affords preferential dorsiflexion in a first direction and stiffening in an opposing direction for plantar flexion and foot support.

In any of the embodiments contemplated herein, the dance shoe has a foot-receiving compartment 10 that covers some or all the top of the user's foot. A sole unit, consisting of a structure suitable for ground contact, is disposed on the bottom portion of the compartment. Often, compartment 10 is as full-length covering that is formed of a distal part 12, an intermediate part 13, and a proximal part 14. Distal part 12 of foot-receiving compartment 10 generally corresponds to a forefoot region of a foot, and it is configured to receive at least a portion of a forefoot of the intended wearer. Intermediate part 13 generally corresponds to a midfoot region of a foot, and it is configured to receive at least a portion of a midfoot of the intended wearer. Proximal part 14 of foot-receiving compartment 10 generally corresponds to a rearfoot region of a foot, and it is configured for receiving at least a rearfoot region of the foot. The intermediate part 13 is coupled to both the distal part 12 and the proximal part 14. They may be attached as separate pieces, or formed as a unitary piece.

The foot-receiving compartment 10 generally consists of a shoe upper 44 that is attached to a sole unit 40 disposed on the bottom side of the shoe. The sole unit may be a full length sole unit or a partial sole unit, e.g., just forefoot and rearfoot sole. Seams may be used to join portions of fabric. The upper may be a full or partial encasing for the foot. For example, it may have portions that encase the sides and top of the foot and connect to a sole unit that forms a bottom portion of the shoe. Or, it may include a bottom portion connected to the side portions, creating a sock-like structure, for fully encasing the foot, for instance, with the bottom portion connecting directly or indirectly to a sole unit such as an outsole or an assembly of a midsole and outsole. In certain applications, the non-toe box part of the foot-receiving compartment, i.e., the midfoot and rearfoot portions, will be constructed of one or more thin, flexible plies of materials that can conform to the foot similar to the way a sock does. By comparison, for example, most athletic or work shoes have relatively bulky, non-conforming rubber or other molded-polymer outsoles and midsoles in the midfoot and rearfoot portions that prevent a sock-like fit. And their uppers may include relatively non-compliant portions such as natural and synthetic leathers, molded plastic sections, or plies of material that while flexible are not very compliant, i.e., they do not conform easily to the contour of a foot. In other embodiments, straps, mesh of perforated materials may be used in areas of the foot compartment instead of continuous sheet material.

In dance shoes, the foot-receiving compartment 10 may be primarily made of a satin or satin-like textile material, canvas, leather, or various other soft and thin ply materials. It some embodiments, it may be made in whole or part of a single-ply of thin, flexible material (except possibly for the toe box structure, a thin comfort lining and/or an optional insole). In other embodiments, the foot-receiving compartment may be made of multiple plies of material, or a combination of single-ply and multi-ply materials. In some embodiments, the inside of the foot-receiving compartment 10 may be provided with a liner inside a ply of an outer-facing material, such as a ply of satin.

In certain embodiments of the inventive subject matter, the distal part 12 of foot-receiving compartment 10 includes a rigid toe box 16 or other rigid compartmental portion that provides support for a dancer to stand or balance in demi and en pointe positions. In some embodiments, the pointe shoe may have pleats 18 at the front of the foot-receiving compartment 10, e.g., at front of toe box 16. Pleats are created when upper is folded into the bottom of the shoe underneath front sole.

The sole unit 40 may be a structure that functions as an outsole and optionally a midsole and/or an insole. A sole shank may be incorporated into any layer of the sole unit and it may form in whole or part any one or more of the outsole, midsole, or insole. The sole unit 40 can be selected and configured to provide any number of attributes, including traction or lack of traction (e.g., a smooth surface for spin moves), protection, and/or force dissipation or force return. A sole unit may be fashioned to have multiple attributes in a given zone of the foot. Similarly, a sole unit may be fashioned to have multiple zones, each with a unique set of attributes.

As shown in the Figures, per some embodiments of the inventive subject matter, the sole unit 40 includes a sole shank, which is configured to extend longitudinally from the distal part 12 to the proximal part 14 of a shoe.

Figure 9:
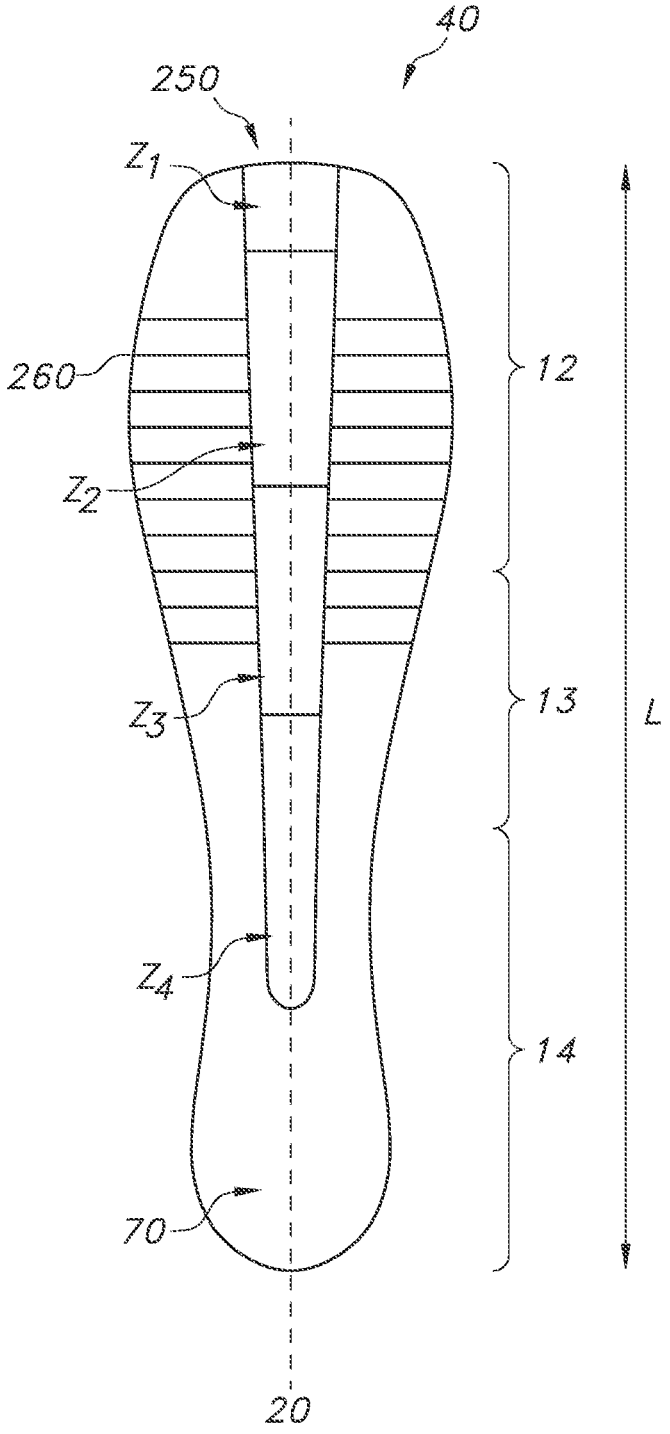
FIG. 9 shows an alternative embodiment of a sole unit including a sole shank attached to layers of board.
Figure 10:
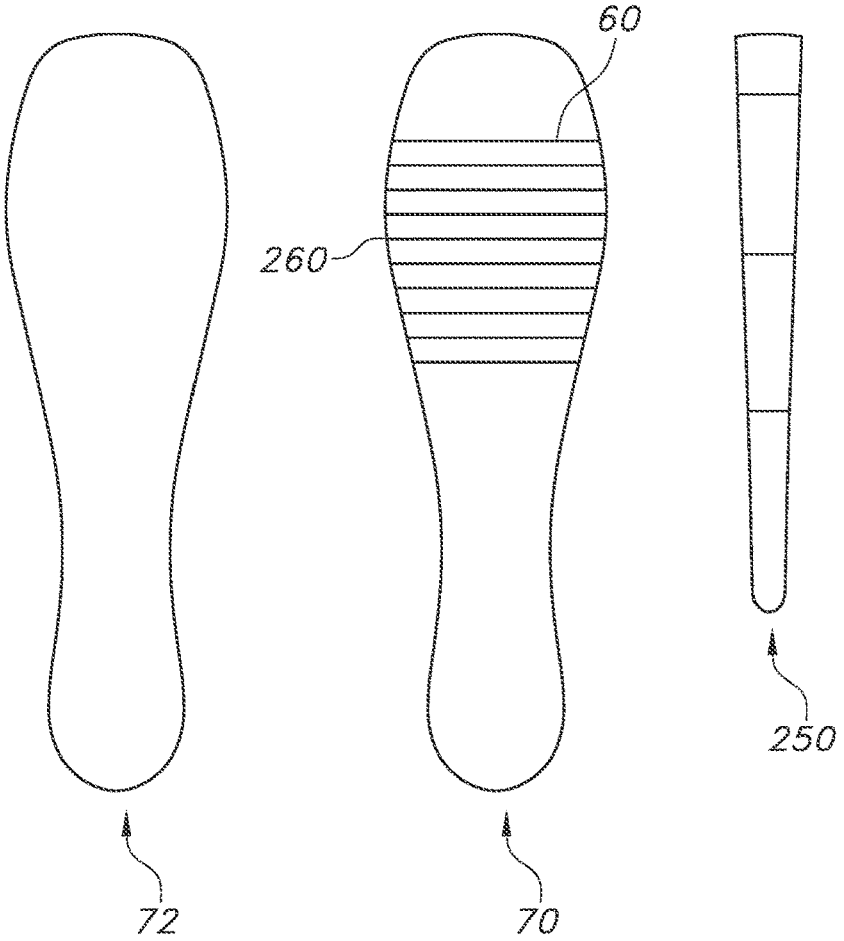
FIG. 10 shows isolated view of components included in the sole unit of FIG. 9.

The dimension of any sole shank may vary with respect to a sole unit 40. In one embodiment, as illustrated in FIGS. 1-8, for example, the length of the sole shank is about equal to the full length of the sole unit (i.e., the length of the sole shank is at least greater than 0.85 L), such that the distal end of the sole shank is generally located under the toes, and the proximal end of the sole shank is generally located under the heel. In another embodiment, as illustrated in FIGS. 9-10, the length of the sole shank is longer than half but shorter than full length of the sole unit. In one particular embodiment, the length of the sole shank is about equal to three-quarter length of the sole unit, i.e., the length of the sole shank is between 0.65 L-0.85 L. Yet in another embodiment, the length of the sole shank is about equal to the half-length of the sole unit, i.e. the length of the sole shank is between 0.4 L-0.65 L.

FIG. 6A shows the top view of a dance shoe having an alternative sole shank 150, which includes a single forefoot hinge 160 that runs across substantially the full width of the sole shank. However, such a shoe may be used with other embodiments, including sole shank 50 or 250. The shoe has a length of L, which is measured longitudinally between the farthest points separating toe and heel. The width of the shoe, which is measured transversely, may vary along the longitudinal direction. For example, the midfoot region may be slightly narrower than the forefoot region and rearfoot region. The shoe is approximately symmetric about a central axis 20 in the longitudinal direction.

In some embodiments, such as that of FIGS. 1-8, the width of the sole shank is about equal to the width of the sole unit 40, i.e., the medial and lateral edges of the sole shank generally match respectively the medial and lateral boundaries of the sole unit. In other embodiments, as illustrated in FIGS. 9-10, the width of the sole shank is substantially narrower than the width of the sole unit 40, wherein "substantially narrower" means that the width of the sole shank, at any point along the longitudinal direction, is less than half width of the sole unit.

Generally, the sole shank is arranged along and over a central axis 20 in the longitudinal direction of the shoe. In certain embodiments, as shown in FIGS. 9-10, the sole shank 250 may have a tapering form, such that its width is larger in the distal region and smaller in the proximal region.

According to certain embodiments of the inventive subject matter, the sole shank includes a resilient board or plate structure that may extend in two or three dimensions. The resilient plate structure may have tuned flexibility, i.e., different areas of the resilient board or plate structure may have selectively different stuffiness or flexibility. In some embodiment, a resilient plate structure may be a fiber-reinforced plastic (FRP) plate. As known in the art, FRP is a composite material made of a polymer matrix reinforced with fibers. The fibers are usually glass, carbon, aramid, or basalt. Possibly, other fibers such as paper or wood or asbestos may be used. The polymer is usually an epoxy, vinylester or polyester thermosetting plastic, and phenol formaldehyde resins may also be used.

A polymer is generally manufactured by step-growth polymerization or addition polymerization. When combined with various agents to enhance or in any way alter the material properties of polymers the result is referred to as a plastic. Composite plastics refer to those types of plastics that result from bonding two or more homogeneous materials with different material properties to derive a final product with certain desired material and mechanical properties. FRPs are a category of composite plastics that specifically use fiber materials to mechanically enhance the strength and elasticity of plastics. The original plastic material without fiber reinforcement is known as the matrix. The matrix is a tough but relatively weak plastic that is reinforced by stronger stiffer reinforcing filaments or fibers. The extent that strength and elasticity are enhanced in a FRP depends on the mechanical properties of both the fiber and matrix, their volume relative to one another, and the fiber length and orientation within the matrix. Reinforcement of the matrix occurs when the FRP material exhibits increased strength or elasticity relative to the strength and elasticity of the matrix alone. FRP involves two distinct processes, the first is the process whereby the fibrous material is manufactured and formed, the second is the process whereby fibrous materials are bonded with the matrix during moulding.

Reinforcing fiber may be manufactured in both two-dimensional and three-dimensional orientations. Fiber preforms are how the fibers are manufactured before being bonded to the matrix. Fiber preforms are often manufactured in sheets, continuous mats, or as continuous filaments for spray applications. Some major ways to manufacture the fiber preform is through the textile processing techniques of weaving, knitting, braiding, and stitching.

A rigid structure is usually used to establish the shape of FRP components. Parts can be laid up on a flat surface referred to as a "caul plate" or on a cylindrical structure referred to as a "mandrel". However, most FRP parts are created with a mold or "tool." Molds can be concave female molds, male molds, or the mold can completely enclose the part with a top and bottom mold. The moulding processes of FRP begins by placing the fiber preform on or in the mold. The fiber preform can be dry fiber, or fiber that already contains a measured amount of resin called "prepreg". Dry fiber is "wetted" with resin either by hand or the resin is injected into a closed mold. The part is then cured, leaving the matrix and fibers in the shape created by the mold. Heat and/or pressure are sometimes used to cure the resin and improve the quality of the final part. Some methods of forming include bladder molding, compression molding, autoclave/vacuum bag, mandrel wrapping, wet layup, chopper gun, filament winding, pultrusion, and resin transfer molding.

The matrix must also meet certain requirements in order to first be suitable for FRPs and ensure a successful reinforcement of itself. The matrix must be able to properly saturate, and bond with the fibers within a suitable curing period. The matrix should preferably bond chemically with the fiber reinforcement for maximum adhesion. The matrix must also completely envelop the fibers to protect them from cuts and notches that would reduce their strength, and to transfer forces to the fibers. The fibers must also be kept separate from each other so that if failure occurs it is localized as much as possible, and if failure occurs the matrix must also de-bond from the fiber for similar reasons. Finally, the matrix should be of a plastic that remains chemically and physically stable during and after the reinforcement and moulding processes. To be suitable as reinforcement material, fiber additives must increase the tensile strength and modulus of elasticity of the matrix and meet the following conditions; fibers must exceed critical fiber content; the strength and rigidity of fibers itself must exceed the strength and rigidity of the matrix alone; and there must be optimum bonding between fibers and matrix.

One representative example of the FRP plate is a carbon fiber plate. The plate is formed from a fiber preform, for example, the preform may be one or more layers of carbon fibers or filaments. Carbon filaments in each layer may be arranged in varying density and/or weave pattern to give the carbon fiber plate varying strength-to-weight ratio and rigidity. The fiber preform may be resin impregnated. The properties of the plate, e.g., strength and rigidity, may be varied according to the type of fiber preform and matrix being used.

In certain embodiments, an FRP plate shank may be affixed to or embedded within one or more boards or other layers of a sole unit 140 or a sole shank, which may be part of the sole unit or the upper. A board may be, but is not limited to, a leather board, a fiber board, a cellulose board, or a cardboard. For example, FIGS. 9-10 show a sole unit 140 including a shank 250, which is made of a carbon fiber or other FRP plate, and which is affixed to a layer of thin, but relatively stiff, grey board 70. The grey board is disposed on top of another layer of relatively flexible leather board (not shown in FIG. 9 but seen in the exploded view of FIG. 10). The grey board has several laser-cut or mechanically formed lines 260, serving as living hinges, formed partially through its thickness in the forefoot region for facilitating flexibility in that region.

In the various embodiments, a sole shank may be flat or it may pre-shaped in three dimensions (e.g., by using a moldable material). For example, the sole shank may be pre-shaped in a plantar-flexed position near an arch portion 64 of the foot, as illustrated in FIG. 8, for example. This may facilitate plantar flexion of the foot, e.g. when the dancer transitions to en pointe and tendu positions, as the sole shank 150 tends to return to its pre-shaped position. In addition, the shoe may be made on a last representing a pronounced plantar flexion. In certain embodiments, the plantar flexion corresponds to or mimics the shape of a foot when en pointe, for example the last may have a curved profile in mimicking the profile of a foot when en pointe, resulting in a shoe having a corresponding curvature. As known in the art, a last is a shaped, three-dimensional body corresponding to a size and shape of a model foot. Shoe parts, including those that form the foot-receiving compartment, are placed around the last form, and assembled together. Once assembled in the shape of the last, the last is removed. The sole unit may be assembled to the compartment while it is on the last.

Figure 7A:
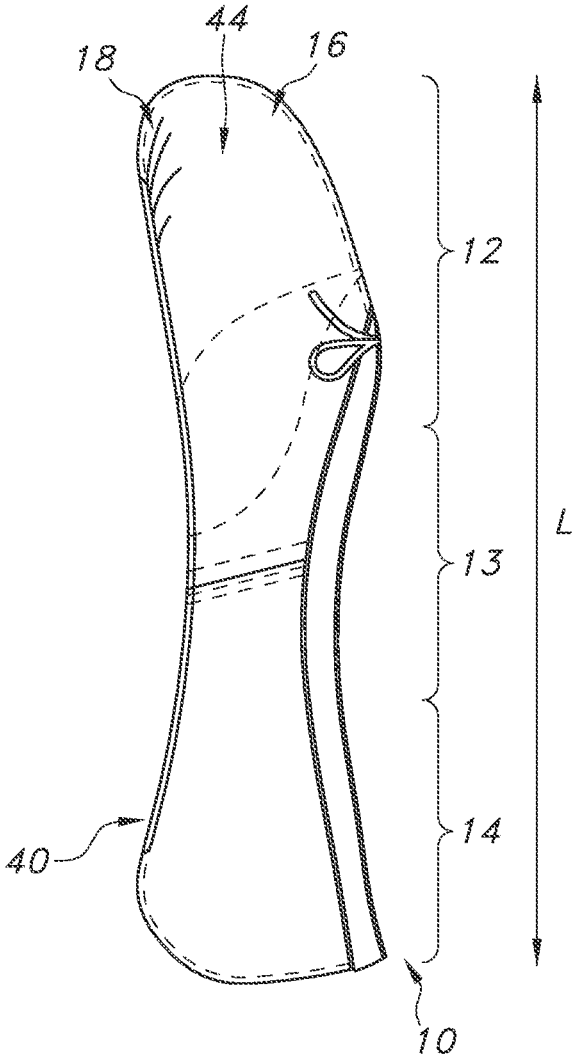
FIGS. 7A-7B show a side view of the dance shoe of FIG. 6, and a separate view of its sole shank with multiple zones of varying flexibility.
Figure 7B:
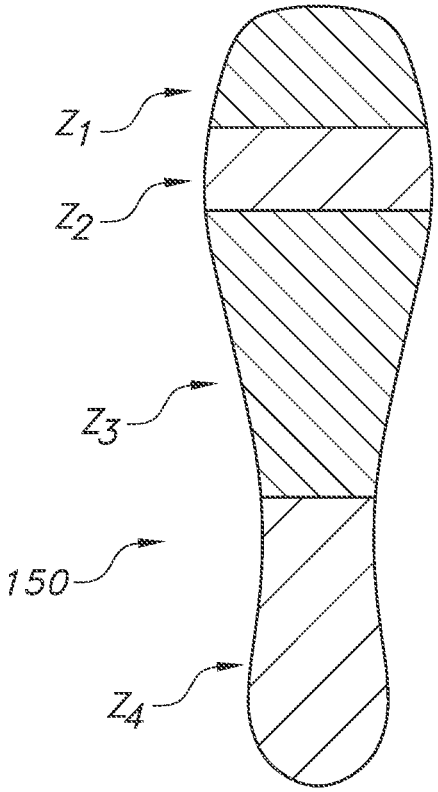

Per certain embodiments of the inventive subject matter, an example of which is seen in FIG. 7B, a sole shank 150 has at least three zones $Z_1$, $Z_2$, $Z_3$ of varying flexibility along its longitudinal axis, including a relatively stiff zone $Z_1$ located near a toe portion of the foot, a relatively flexible zone $Z_2$ located near a ball portion of the foot, and a relatively stiff zone $Z_3$ located near an arch portion of the foot, which may have the same stiffness as $Z_1$ or may be more or less stiff.

In one exemplary embodiment, as illustrated in FIG. 7B and FIG. 9, the sole shank 250 has four zones of varying flexibility along its longitudinal axis, including a stiff zone $Z_1$ located near a toe portion of the foot, a flexible zone $Z_2$ located near a ball portion of the foot, a stiff zone $Z_3$ located near an arch portion of the foot, and a flexible zone $Z_4$ located near a rearfoot portion of the foot. (As in other examples, references to stiffness of one zone to another are relative determinations.) The stiff zones $Z_1$, $Z_3$ in the sole shank provide extra support for the toe portion and near the arch portion of the foot, particularly when the foot is in plantar flexion. The flexible zones $Z_2$, $Z_4$ in the sole shank allow sufficient flexibility of the foot movement during the dancing, e.g., facilitating the dorsiflexion of the foot. The flexible zone $Z_2$ may also be adapted to be springy or bouncy to provide energy return to facilitate forefoot movement during dancing.

As with other embodiments, an FRP sole shank with varying zones of stiffness based on differences in material property may also include a unidirectional stop in the form of a living hinge 160, which allows the sole shank to bend without breaking. The living hinge may be made, for example, from the same material layer or layers as it interconnects. For example, the living hinge could interconnect two sections of carbon fiber with different stiffness or flexibility. In one representative embodiment, the living hinge is formed along the boundary between the stiff zone $Z_1$ corresponding to the toe portion and the flexible zone $Z_2$ corresponding to the ball portion of the foot.

Various methods may be used to create multiple zones of varying flexibility for the sole shank. Per one embodiment, this is achieved by at least varying the thickness of the sole shank, e.g., by employing different number of fiber layers, in different zones. In another embodiment, this is achieved by at least varying composition material of the sole shank in different zones, e.g., the stiffness or flexibility of a fiber preform may vary by changing its durometer, fiber density or thickness, thread count and/or tow size (i.e. number of filament fibers in a bundle). Yet in another embodiment, multiple zones of varying flexibility may be created by at least varying a weave pattern of an FRP or other woven sole shank in different zones. The weave pattern, including the orientation of individual fibers and how the fibers interlace with each other, may affect the stiffness or flexibility of a fiber plate. Some typical weave patterns include, but are not limited to: plain weave, twill weave, satin weave, etc. Custom defined weave patterns may also be used to create desired flexibility.

Terminology and Scope

As used herein, a "plantar flexion" of the foot refers to the downward movement of the foot and toes which increases the approximate 90-degree angle between the front part of the foot and the shin at the neutral position (i.e., foot is flat). A "dorsiflexion" of the foot refers to the upward movement of the foot and toes which decreases the approximate 90-degree angle between the front part of the foot and the shin at the neutral position (i.e., foot is flat).

Figure 11:
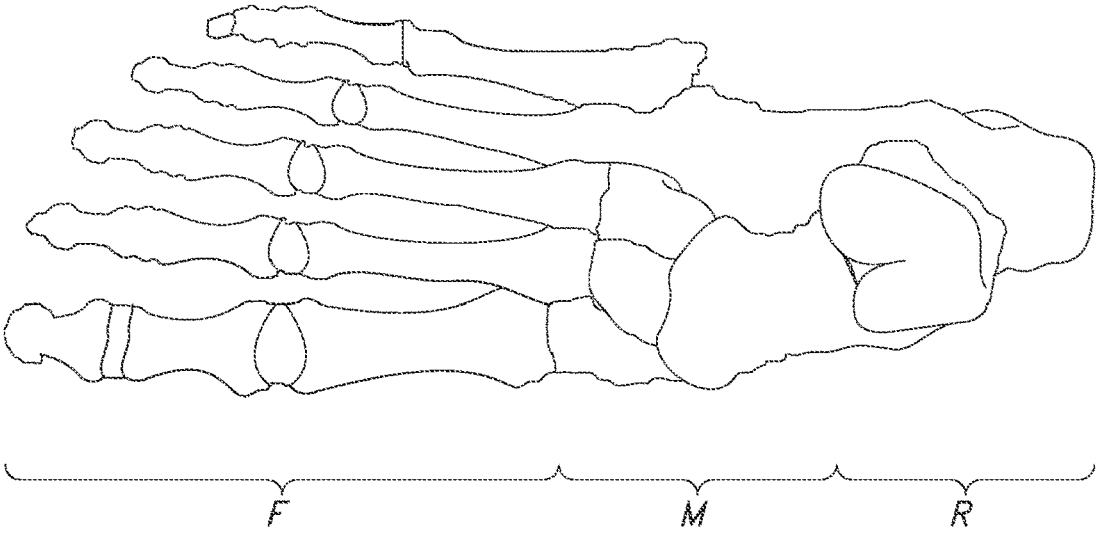
FIG. 11 shows an anatomical mapping of a typical foot.

FIG. 11 is an anatomical mapping of the foot. The "forefoot" includes the toes and metatarsals and it provides the ground contact area of the ball of the foot. It consists of most of the bony architecture of the foot including phalanges to the toes, five metatarsal bones and the two sesamoid bones of the big toe joint. The "midfoot" is the intersection between the forefoot and rearfoot. Its anatomic location is at the peak or highest part of the arch and has important joints connecting it to the forefoot and the rearfoot region. It consists of five bones including three cuneiform bones, and the navicular and cuboid bones. The "rearfoot" connects to the midfoot and to the ankle and provides the ground contact area of the heel region of the foot. It consists of the bony architecture of the calcaneus and talus.

Accordingly, in the inventive shoes, the "forefoot region" of the compartment refers generally to a portion of the compartment receiving the toes as well as the metatarsals of the foot of a wearer. The "midfoot region" of the compartment refers generally to a portion of the compartment receiving the arch of the foot of a wearer. The "rearfoot region" of the compartment refers generally to a portion of the compartment receiving the heel of the wearer.

Persons skilled in the art will recognize that many modifications and variations are possible in the details, materials, and arrangements of the parts and actions which have been described and illustrated to explain the nature of the inventive subject matter, and that such modifications and variations do not depart from the spirit and scope of the teachings and claims contained therein.

The principles described above about any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be plain to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

As used herein the terms "part", "portion", and "section" are generally synonymous terms and do not imply that something is or is not a discrete element or subcomponent in a larger construct or is or is not a non-discrete subdivision of a larger unitary construct, unless context indicates otherwise.

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

While the inventors understand that claims are not a necessary component of a provisional patent application, and therefore has not included detailed claims, the inventors reserve the right to claim, without limitation, at least the following subject matter.

The invention claimed is:

1. A dance shoe having an upper and an underfoot portion, the underfoot portion including a sole shank, comprising:

a stiff structure, extending longitudinally in the shoe over at least a forefoot portion of the shoe and at least partially over a midfoot portion, a plurality of hinges, each with a unidirectional stop being disposed widthwise in the sole shank in at least the forefoot portion so that a forefoot portion of the sole shank locks by the unidirectional stops to support plantar flexion and hinges to facilitate dorsiflexion of the foot and follow dorsiflexion of an intended wearer's forefoot, wherein a portion of the sole shank in a midfoot position is conformable to an arch of the intended wearer's foot in plantar flexion, the sole shank being coupled to a rigid distal part of the shoe, and wherein one or more hinges comprise a curving undulating form.

2. The dance shoe of claim 1 wherein there are three or more living hinges with an undulating form comprising curved lines having at least two extrema.

3. The dance shoe of claim 1 wherein the length of the sole shank is about equal to the full length of the sole unit.

4. The dance shoe of claim 1 wherein the length of the sole shank is longer than half but shorter than full length of the sole unit.

5. The dance shoe of claim 4 wherein the width of the sole shank is about equal to the width of a sole unit in the dance shoe.

6. The dance shoe of claim 1 wherein the width of the sole shank is substantially narrower than the width of the sole unit, and the sole shank is disposed substantially on a central axis of the shoe.

7. The dance shoe of claim 1 wherein the sole shank is pre-shaped in a three-dimensional form to facilitate plantar flexion of the intended wearer's foot.

8. The dance shoe of claim 7 wherein the three-dimensional form represents an intended wearer's foot in a plantar-flexed position, in particular a curved shape near an arch portion of the intended wearer's foot.

9. A dance shoe, comprising:

a distal part having a rigid toe box for encasing at least a portion of a forefoot of an intended wearer and supporting a foot of the intended wearer;

an intermediate part coupled to the distal part and configured for receiving at least a portion of a midfoot of the intended wearer;

a proximal part coupled to the intermediate part and configured for receiving at least a rearfoot portion of the intended wearer; and a sole unit comprising a sole shank extending longitudinally from the distal part to the proximal part, wherein the sole shank has at least a plurality of hinges each with a unidirectional stop disposed widthwise in the sole shank in at least a forefoot portion that locks by the unidirectional stops to support plantar flexion and hinges to facilitate dorsiflexion of the forefoot portion and follow dorsiflexion of an intended wearer's forefoot, and wherein an arch portion of the sole shank in a midfoot position has a curved shape in an unstressed condition that mimics an arch of the intended wearer's foot in plantar flexion, the shank under the stress of a foot position other than plantar flexion resiliently returning to the curved shape when unstressed.

10. A dance shoe having an upper and underfoot portion, the underfoot portion including a sole shank comprising:

a stiff structure, extending longitudinally in the shoe over at least a forefoot portion of the shoe and the least partially over a midfoot portion, a plurality of hinges, each with a unidirectional stop being disposed widthwise in the sole shank in a least the forefoot portion so that a forefoot portion of the sole shank locks by the unidirectional stops to support plantar flexioin and hinges to facilitate dorsiflexion of the foot and follow dorsiflexion of an intended warer's forefoot, wherein each hinge comprises a pair of opposing walls that are separated from each other in a neutral position and that converge toward abutment in plantar flexion, wherein a portion of the sole shank in a midfoot position is conformable to an arch of the intended wearer's foot in plantar flexion, the sole shank being coupled to a rigid distal part of the shoe, and wherein a depth of a first living hinge differs from a depth of a second living hinge.

11. A dance shoe having an upper and underfoot portion, the underfoot portion including a sole shank comprising:

a stiff structure, extending longitudinally in the shoe over at least a forefoot portion of the shoe and the least partially over a midfoot portion, a plurality of hinges, each with a unidirectional stop being disposed widthwise in the sole shank in a least the forefoot portion so that a forefoot portion of the sole shank locks by the unidirectional stops to support plantar flexioin and hinges to facilitate dorsiflexion of the foot and follow dorsiflexion of an intended warer's forefoot, wherein each hinge comprises a pair of opposing walls that are separated from each other in a neutral position and that converge toward abutment in plantar flexion, wherein a portion of the sole shank in a midfoot position is conformable to an arch of the intended wearer's foot in plantar flexion, the sole shank being coupled to a rigid distal part of the shoe, and wherein a depth of a first living hinge varies across the first living hinge.

12. A dance shoe having an upper and an underfoot portion, the underfoot portion including a sole shank, comprising:

a stiff structure, extending longitudinally in the shoe over at least a forefoot portion of the shoe and at least partially over a midfoot portion, a plurality of hinges, each with a curving, undulating form and a unidirectional stop being disposed widthwise in the sole shank in at least the forefoot portion so that a forefoot portion of the sole shank locks by the unidirectional stops to support plantar flexion and hinges to facilitate dorsiflexion of the foot and follow dorsiflexion of an intended wearer's forefoot, wherein each hinge comprises a pair of opposing walls that are separated from each other in a neutral position and that converge toward abutment in plantar flexion, and wherein a portion of the sole shank in a midfoot position is conformable to an arch of the intended wearer's foot in plantar flexion, the sole shank being coupled to a rigid distal part of the shoe.

* * * * *